US007475458B1

(12) United States Patent
Gordon et al.

(10) Patent No.: US 7,475,458 B1
(45) Date of Patent: Jan. 13, 2009

(54) DISPLAY CASKET WITH INTERLOCKING FEATURE TO BURIAL CONTAINER

(75) Inventors: John Brent Gordon, Durant, OK (US); Billy Frank Dotson, Jr., Kaufman, TX (US)

(73) Assignee: Compassionate Funeral Systems, Inc., Kaufman, TX (US)

( * ) Notice: Subject to any disclaimer, the term of this patent is extended or adjusted under 35 U.S.C. 154(b) by 0 days.

(21) Appl. No.: 11/967,418

(22) Filed: Dec. 31, 2007

(51) Int. Cl.
*A61G 17/00* (2006.01)

(52) U.S. Cl. ..... 27/35; 52/138

(58) Field of Classification Search ..... 27/35, 27/27, 2, 1; 52/128, 133, 138; 220/23.89
See application file for complete search history.

(56) References Cited

U.S. PATENT DOCUMENTS

| | | | | |
|---|---|---|---|---|
| 748,692 | A | 1/1904 | Booth | |
| 813,942 | A | 2/1906 | Blake | |
| 1,048,361 | A | 12/1912 | Sievert | |
| 1,065,579 | A | 6/1913 | Bentley | |
| 1,128,865 | A | 2/1915 | Freeman | |
| 1,833,547 | A | 11/1931 | Wollitz | |
| 2,007,119 | A * | 7/1935 | Harris | 27/35 |
| 2,167,001 | A | 7/1939 | Oppenheim | |
| 2,289,406 | A | 7/1942 | Beranek | |
| 3,050,818 | A | 8/1962 | Phillips | |
| 3,133,334 | A | 5/1964 | Johnsen | |
| 3,613,189 | A | 10/1971 | Kirby | |
| 3,654,676 | A | 4/1972 | McHugh | |
| 3,810,282 | A | 5/1974 | Doggett | |
| 3,815,185 | A | 6/1974 | Owens | |
| 4,063,337 | A | 12/1977 | Havey, III | |
| 4,177,543 | A | 12/1979 | Angermann | |
| 4,372,018 | A * | 2/1983 | Miller et al. | 27/35 |
| 4,788,757 | A * | 12/1988 | Bethune et al. | 27/2 |
| 5,481,785 | A | 1/1996 | Minton et al. | |
| 5,592,723 | A * | 1/1997 | Leijonhufvud et al. | 27/2 |
| 5,956,825 | A * | 9/1999 | McCoy et al. | 27/2 |
| 6,385,824 | B1 * | 5/2002 | Schwartz | 27/35 |
| 6,684,467 | B1 * | 2/2004 | Walker | 27/35 |
| 7,302,743 | B2 | 12/2007 | Fash | |
| 2005/0060852 | A1 | 3/2005 | Davis et al. | |
| 2005/0060853 | A1 | 3/2005 | Davis et al. | |
| 2005/0108863 | A1 | 5/2005 | Fash | |
| 2005/0125974 | A1 | 6/2005 | Ozbun | |

* cited by examiner

*Primary Examiner*—William L. Miller

(57) ABSTRACT

A casket assembly comprising a coffin base, an outer decorative casket configured to conceal the coffin base, a first support leaf, and a first operating handle. In one embodiment, the coffin base has a first side and a first ledge projecting outwardly from the first side. The outer decorative casket has a first panel and a first support leaf having first and second edges. The first support leaf is hingedly coupled along the first edge to the first panel and is configured to rotate around the first edge between a stowed position and a coffin-support position. In the coffin-support position, the second edge is proximate an underside of the first ledge. The first operating handle is coupled to the first support leaf and configured to positively lock the first support leaf in the stowed position or the coffin-support position. A method of manufacturing a casket assembly is also provided.

20 Claims, 8 Drawing Sheets

DISPLAY CASKET WITH INTERLOCKING FEATURE TO BURIAL CONTAINER

TECHNICAL FIELD

The invention is directed, in general, to caskets and, more specifically, to a reusable, display casket with an interlocking feature to an enclosed burial container.

BACKGROUND

Interment systems employing a re-useable, decorative outer casket housing and concealing an inner, relatively inexpensive, interment coffin have been addressed in the prior art several times. Caskets of this type have a relatively large field of use among persons of limited means, since they lend comfort and solace to the mourners by avoiding the appearance of cheapness and drabness, while at the same time materially reducing the cost of disposition of the deceased.

In some prior art cases, the system was designed for viewing the deceased prior to cremation with the separable remains container specifically designed and constructed for cremation thereby affording a considerable financial savings to the next of kin by only cremating the remains and the remains container. In other embodiments, a combination of an outer casket with a detachable base, or an outer re-useable bottomless casket and an inner simpler casket for interment achieved a similar savings. In some cases, the latch/locking mechanism between the outer casket and the inner remains container presented visible exterior latches, mechanisms, accesses, etc., thereby detracting from the intended illusion. In another case, the interment system was designed to interact with a coffin-lowering mechanism at the gravesite to release the interlocks between the inner coffin and the outer casket, thereby requiring additional graveside mechanism. In several prior art, mechanisms interlocking the inner coffin and the outer re-useable casket rely heavily upon springs to prevent separation of the inner coffin and outer casket while being carried. Of course, as these springs may weaken through repeated use, the risk of separation of the inner coffin and outer casket increases with age. Still others employed removable/repositionable casket sides or end walls to remove the deceased and the cremation or burial container.

Accordingly, what is needed in the art is an interment system offering a re-useable outer casket façade and a cooperating inner interment coffin of moderate cost that does not suffer from the deficiencies of the prior art.

SUMMARY

To address the above-discussed deficiencies of the prior art, one aspect of the invention provides a casket assembly comprising a coffin base, an outer decorative casket configured to conceal the coffin base, a first support leaf, and a first operating handle. In one embodiment, the coffin base has a first side and a first ledge projecting outwardly from the first side. The outer decorative casket has a first panel and a first support leaf having first and second edges and hingedly coupled along the first edge to the first panel. The first support leaf is configured to rotate around the first edge between a stowed position and a coffin-support position. In the coffin-support position, the second edge is proximate an underside of the first ledge. The first operating handle is coupled to the first support leaf and configured to positively lock the first support leaf in the stowed position or the coffin-support position. A method of manufacturing and a method of using a casket assembly are also provided.

The foregoing has outlined certain aspects and embodiments of the invention so that those skilled in the pertinent art may better understand the detailed description of the invention that follows. Additional aspects and embodiments will be described hereinafter that form the subject of the claims of the invention. Those skilled in the pertinent art should appreciate that they can readily use the disclosed aspects and embodiments as a basis for designing or modifying other structures for carrying out the same purposes of the invention. Those skilled in the pertinent art should also realize that such equivalent constructions do not depart from the scope of the invention.

BRIEF DESCRIPTION OF THE DRAWINGS

For a more complete understanding of the invention, reference is now made to the following descriptions taken in conjunction with the accompanying drawings, in which.

DETAILED DESCRIPTION OF CERTAIN ASPECTS AND EMBODIMENTS

While the terms "coffin" and "casket" are generally interchangeable within the mortuary industry, for the purposes of this disclosure, the term "coffin" will used to refer to the remains interment vessel, while the term "casket" will be used to refer to the decorative outer vessel. When combined, the casket and coffin will be referred to as a "casket assembly."

Figure 1:
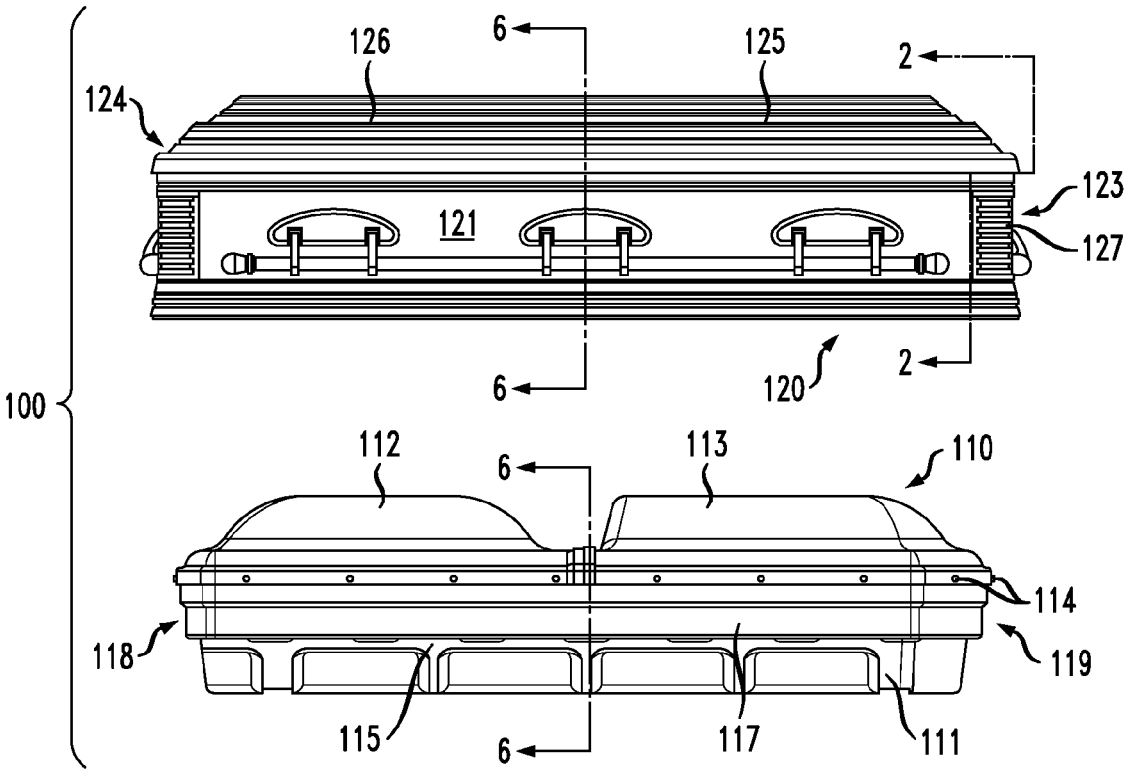
FIG. 1 illustrates a partially exploded front elevation view of one embodiment of a casket assembly constructed according to the principles of the present invention.

Referring initially to FIG. 1, illustrated is a partially exploded front elevation view of one embodiment of a casket assembly 100 constructed according to the principles of the present invention. The casket assembly 100 comprises a coffin 110 and an outer decorative casket 120. When assembled, the outer decorative casket 120 is configured to conceal the inner coffin 110 from mourners and give the impression of a traditional one-piece casket. The outer decorative casket 120 may be constructed from any conventional material routinely used for caskets, i.e., metal, fine wood, etc. to convey the impression of a conventional casket without clues to its inner structure. As the coffin contents will generally come into contact with the deceased, the contents, i.e., upholstery, must be of a one-use nature; whether for burial or for cremation. Therefore, the coffin will include the customary lining, blanket, pillow, etc. The remaining discussion of the coffin will not address these appurtenances as they are well known to one who is of skill in the art. Discussion of the coffin features will be limited to those which are unique or essential to the present invention.

The coffin 110 comprises three pieces: a coffin base 111, a coffin head lid 112 and a coffin foot lid 113. The coffin head lid 112 and coffin foot lid 113 are coupleable to the coffin base 111 with a plurality of fasteners 114. Interposed the coffin base 111 and coffin lids 112, 113 may be a seal (not visible). In one embodiment, the coffin base 111 has a first side 115 and a second parallel side 116 (not visible) and a ledge 117 projecting outwardly from the first side 115. A similar ledge projects outwardly from the second side 116. In the illustrated embodiment, the ledge 117 is continuous and extends around the coffin 110 including the head and foot ends 118, 119, respectively. However, the ledge 117 need not be continuous around the ends 118, 119 as will become apparent in the discussion below.

The outer decorative casket 120 comprises a first (front) panel 121, a second (back) panel 122 (not visible), a foot panel 123, a head panel 124, a foot lid 125, a head lid 126, a front corner 127, and a back corner 128 (not visible). The outer decorative casket 120 does not have a bottom, thereby facilitating placement over the coffin 110. Casket hardware, such as handles, lid hinges, etc., is conventional. The front and back corners 127, 128 are hinged to the foot panel 123, thereby providing access to the internal mechanism.

Figure 2:
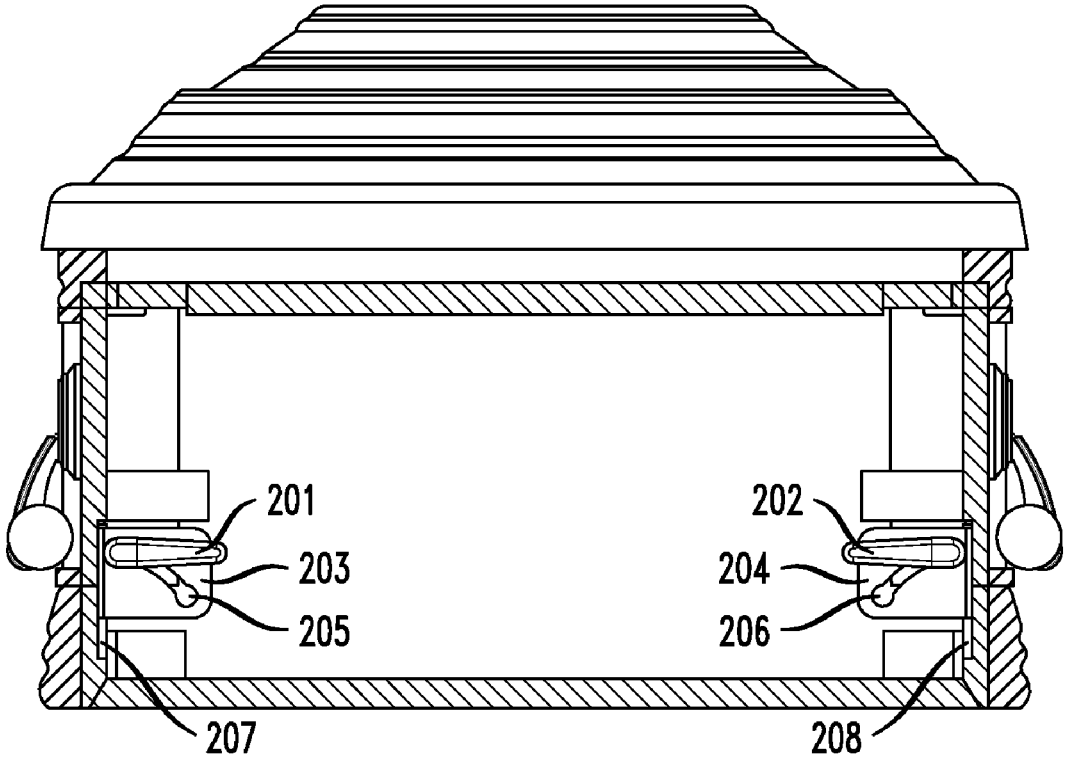
FIG. 2 illustrates a partial sectional view of the outer decorative casket along line 2-2 of FIG. 1.

Referring now to FIG. 2, illustrated is a partial sectional view of the outer decorative casket 120 along line 2-2 of FIG. 1. The outer decorative casket 120 further comprises first and second operating handles 201, 202; first and second operating handle brackets 203, 204 having first and second curvilinear apertures 205, 206; and first and second support leaves 207, 208.

Figure 3:
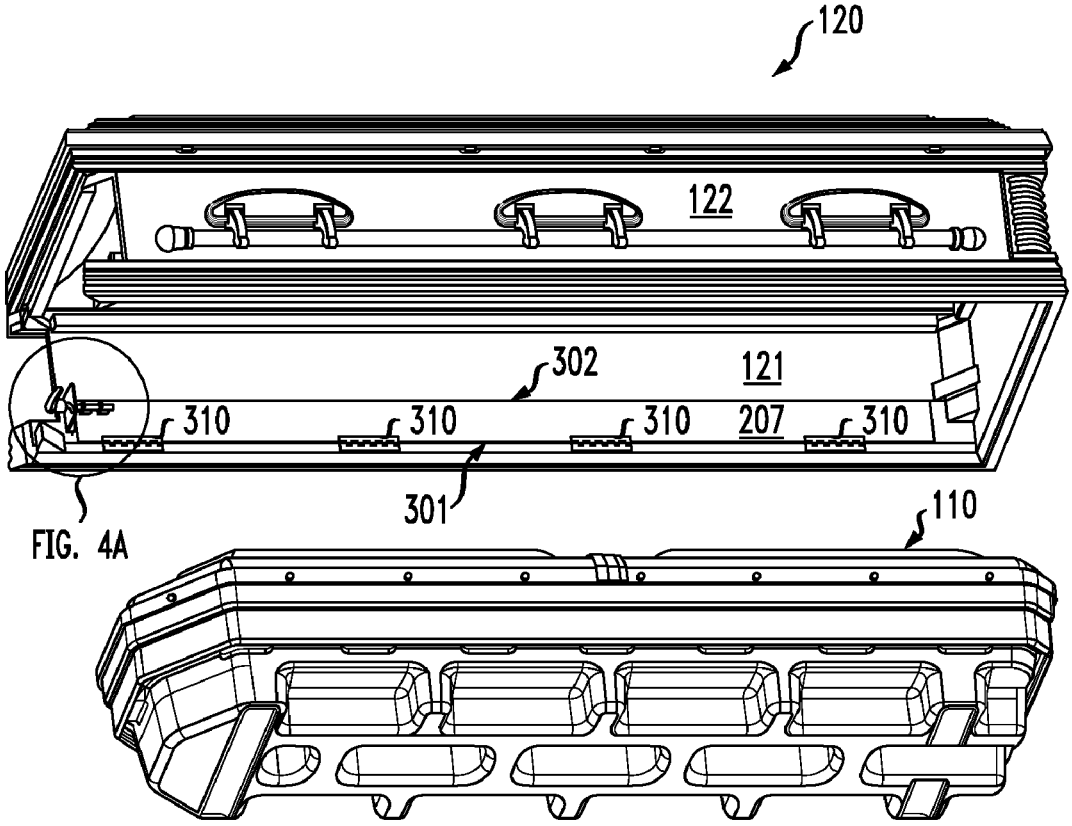
FIG. 3 illustrates a partially exploded, underside isometric view of the outer decorative casket and the coffin showing the inside of the first panel with the first support leaf in a stowed position.

Referring now to FIG. 3, illustrated is a partially exploded, underside isometric view of the outer decorative casket 120 and the coffin 110 showing the inside of the first panel 121 with the first support leaf 207 in a stowed position. The first support leaf 207 has a first edge 301 and a parallel second edge 302. The first support leaf 207 is hingedly coupled along the first edge 301 to the first panel 121 with a plurality of hinges 310. Of course, a single piano hinge could likewise be used. One who is of skill in the art will recognize that an inside view of the second panel 122 is a mirror image of FIG. 3.

Figure 4A:
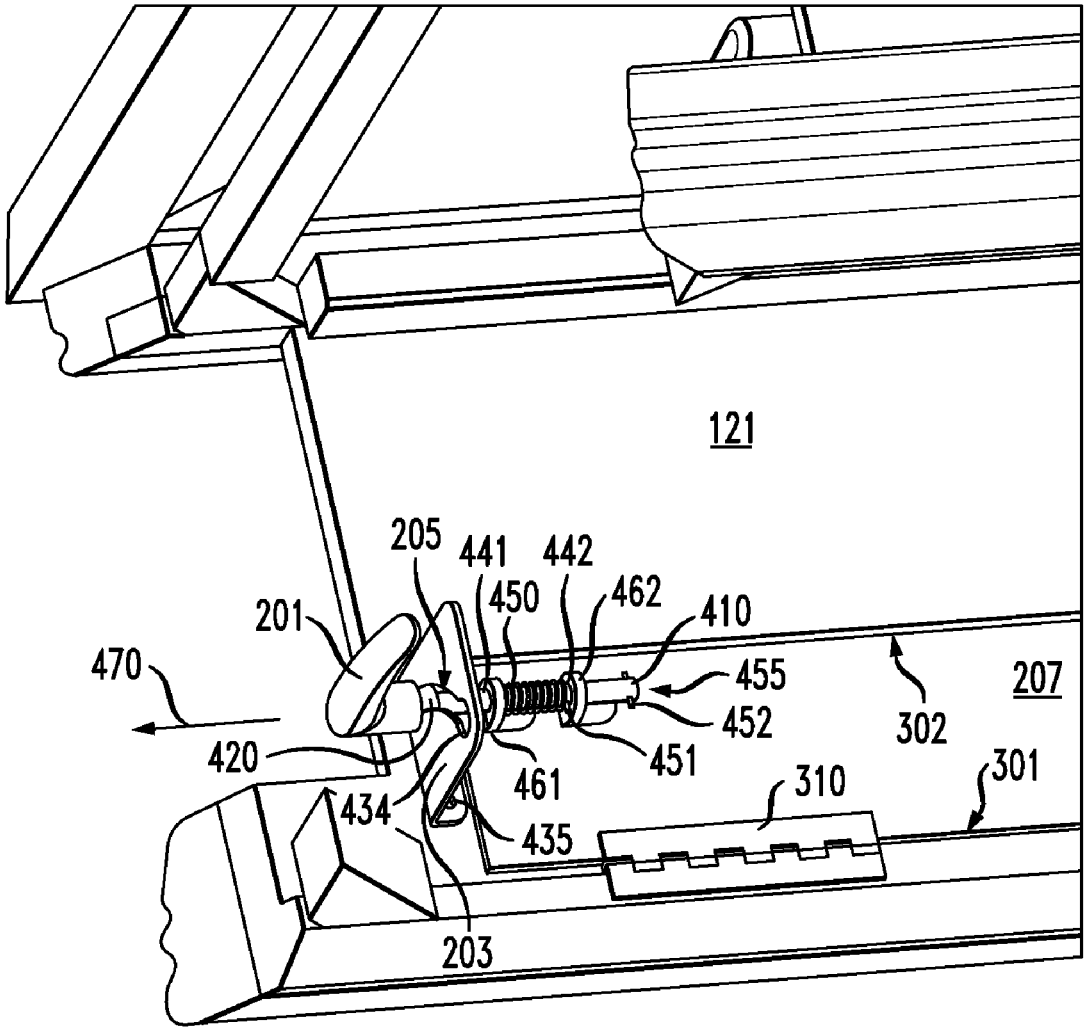
FIGS. 4A and 4B illustrate enlarged isometric views of circled area A of FIG. 3 from two different angles to clarify element interactions.
Figure 4B:
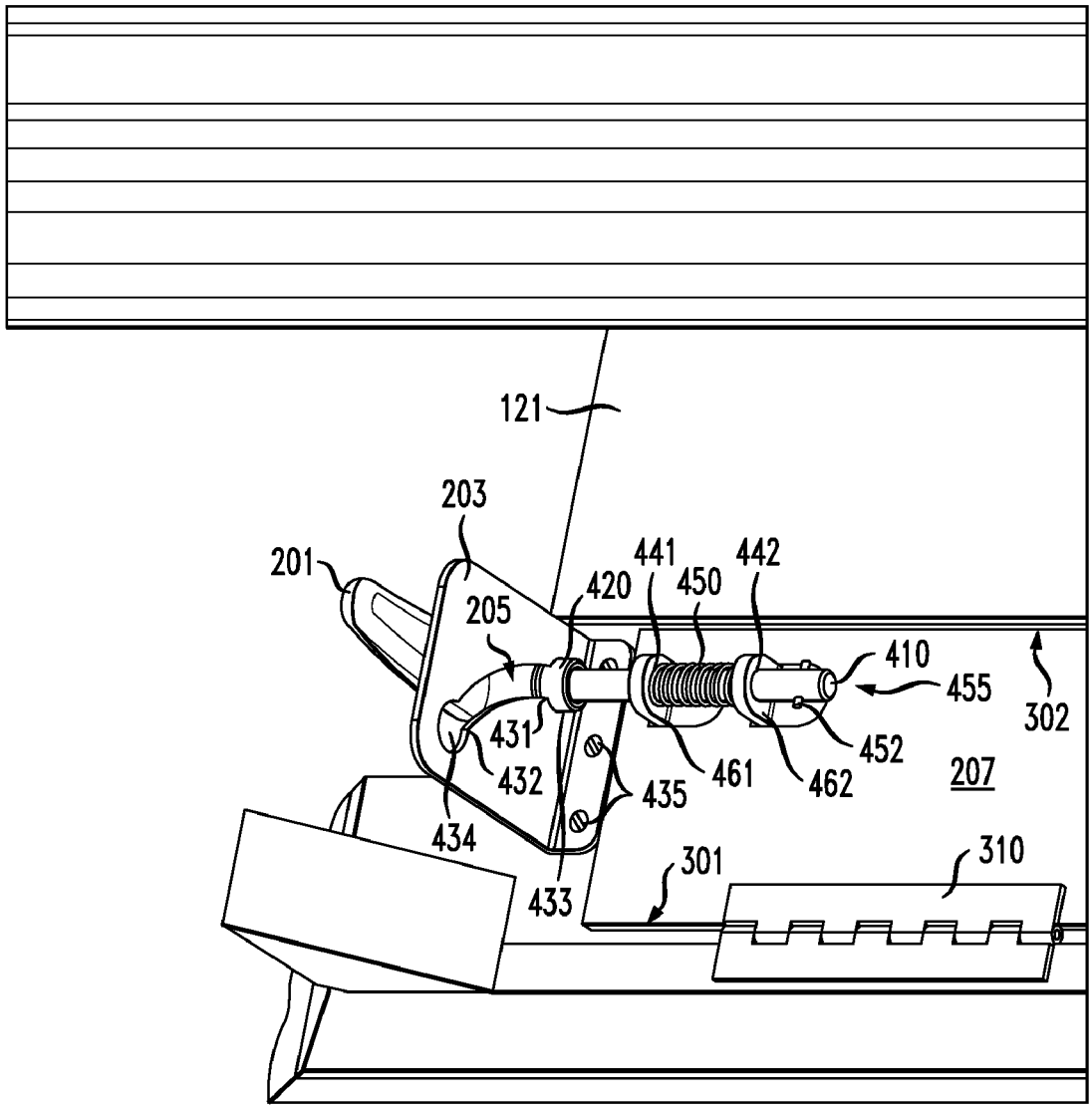

Referring now to FIGS. 4A and 4B, illustrated are enlarged isometric views of circled area A of FIG. 3 from two different angles to clarify element interactions. The first operating handle 201 is coupled to a first rod 410 that has a first collar 420 proximate the first operating handle 201. In one embodiment, the operating handle bracket 203 is coupled to the first panel 121 with screws 435. The first curvilinear aperture 205 has first and second ends 431, 432, respectively, wherein the first end 431 comprises a stowed position aperture 433 and the second end 432 comprises a coffin-support position aperture 434. The first collar 420 cooperates with the stowed position aperture 433 or the coffin-support position aperture 434 to positively lock the first support leaf 207 in the selected position.

FIGS. 4A and 4B illustrate the first collar 420 cooperating with the stowed position aperture 433 to positively lock the first support leaf 207 in the stowed position. First and second rod support brackets 461, 462 are coupled to or formed from the first leaf 207. The first rod 410 passes through the stowed position aperture 433 and the first and second rod apertures 441, 442 in the first and second rod support brackets 461, 462 respectively. A spring stop pin 451 and a rod stop pin 452 pass transversely through the first rod 410. A compression spring 450 surrounds at least a portion of the first rod 410 and is captured between the first rod support bracket 461 and the spring stop pin 451. The rod stop pin 452 is proximate an end 455 of the first rod 410 and prevents the first rod 410 from being inadvertently withdrawn from the first and second rod support brackets 461, 462. One who is of skill in the art will recognize that the second operating handle 202 and second support leaf 208 are a mirror image of the first operating handle 201 and first support leaf 208. Further discussion will therefore be limited to discussion of the first operating handle 201 and the first support leaf 207.

The operation of the casket assembly 100 is as follows: Prior to installing the casket 120 over the coffin 110, corners 127, 128 are rotated open and the support leaves 207, 208 are checked in the stowed position and the corners 127, 128 closed. Lining material as necessary is placed in the coffin base 111. It is most convenient to place the deceased in the coffin base 111 at this time rather than after the casket 120 is placed over the coffin 110. The lining materials are temporarily folded inside of the coffin base 111. If the display is to be with the single head lid open, then the coffin foot lid 113 is placed on the coffin base 111 and secured with fasteners 114. The casket 120 is lowered over the coffin base 111 and coffin foot lid 113. The corners 127, 128 are again rotated open and the first and second operating handles 201, 202 are pulled toward the operator as shown at arrow 470. Resuming discussion solely of the first leaf 207, this handle motion pulls the collar 420 on the first operating handle 201 clear of the stowed position aperture 433. The rod 410 may now slide freely along curvilinear aperture 205 to the coffin-support position aperture 434. The first operating handle 201 is then released in such a way that the collar 420 engages the coffin-support position aperture 434 under the influence of spring 450. The casket assembly 100 is now ready for relocation to a bier (not shown). When placed on the bier, the head lid 126 is opened and the lining materials are placed over a portion of the first panel 121 and the head panel 124, thereby concealing the structure of the inner coffin 110.

Figure 5:
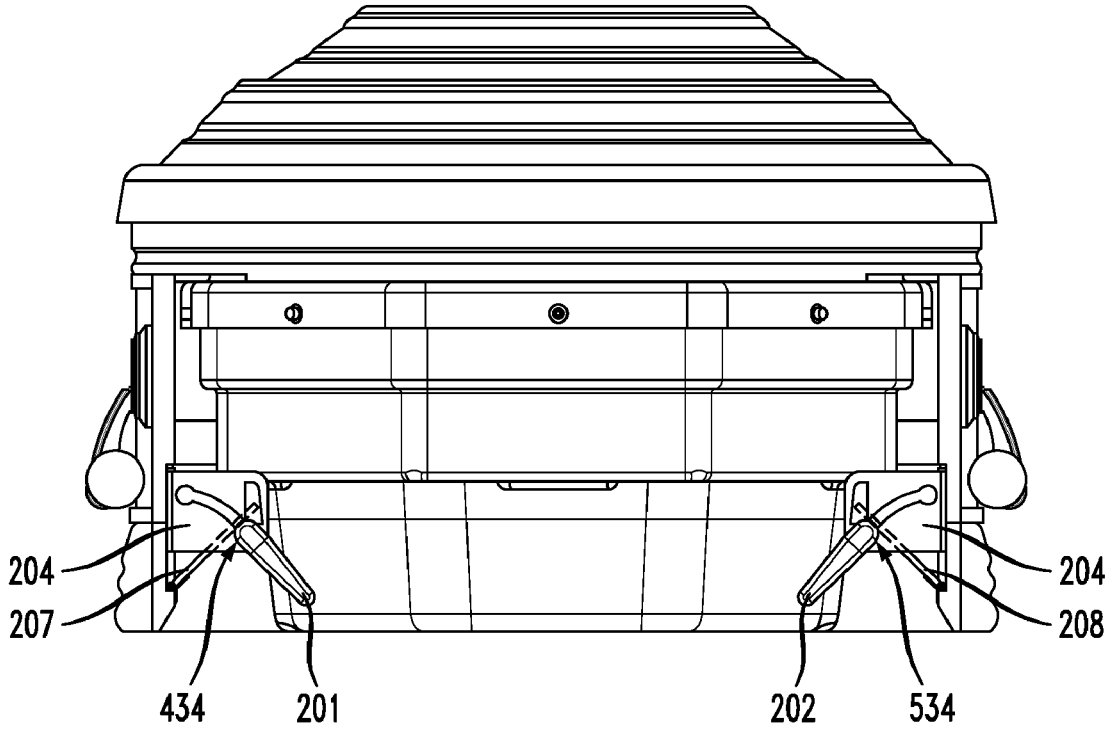
FIG. 5 illustrates a sectional view of the casket assembly along line 2-2 of FIG. 1 showing the first and second operating handle brackets as transparent for clarity, the first and second operating handles in the coffin-support position apertures and the support leaves in the coffin-support position.

Referring now to FIG. 5, illustrated is a sectional view of the casket assembly along line 2-2 of FIG. 1 showing the first and second operating handle brackets 203, 204 as transparent for clarity, the first and second operating handles 201, 202 in the coffin-support position apertures 434, 534 and the support leaves 207, 208 in the coffin-support position.

Figure 6A:
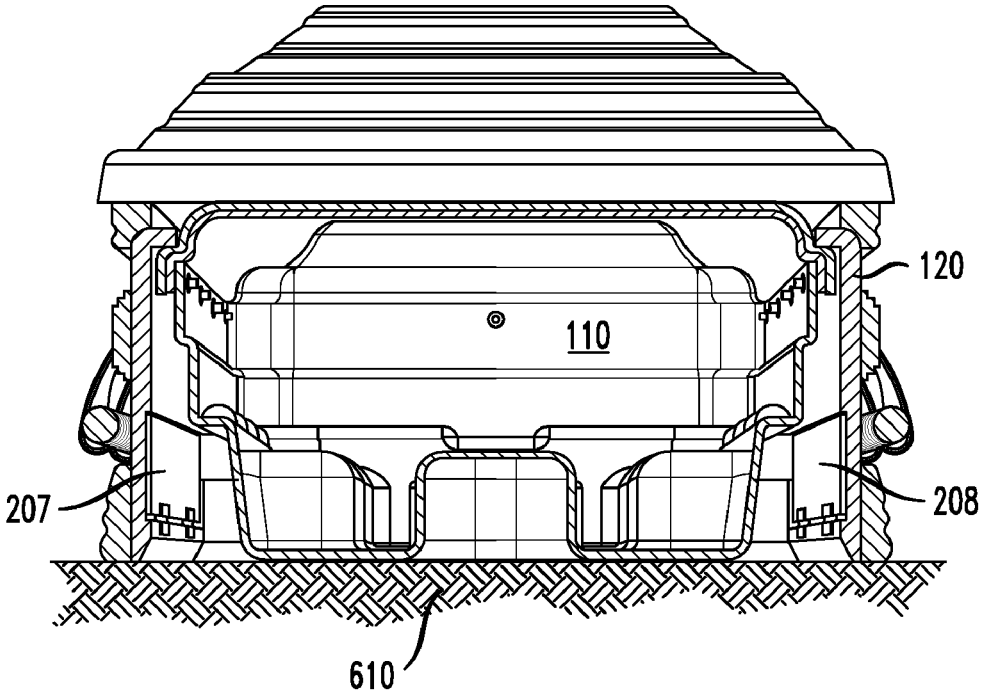
FIG. 6A illustrates the casket assembly with the coffin and casket resting on a surface with the first and second support leaves in the stowed position.
Figure 6B:
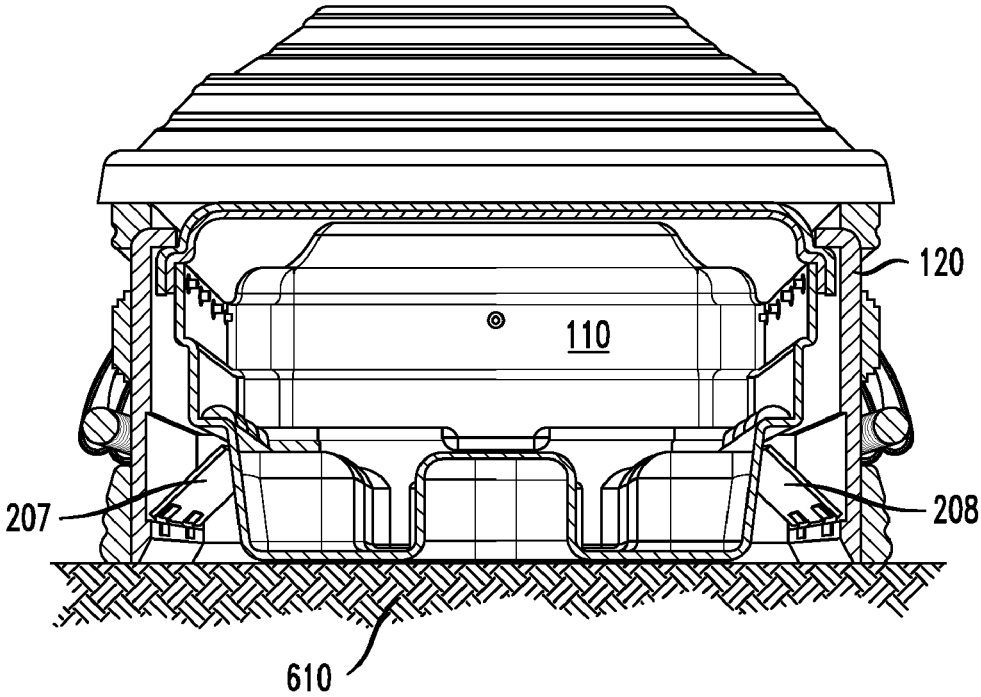
FIG. 6B illustrates the casket assembly with the coffin and casket resting on the surface with the first and second support leaves rotated to the coffin-support position.
Figure 6C:
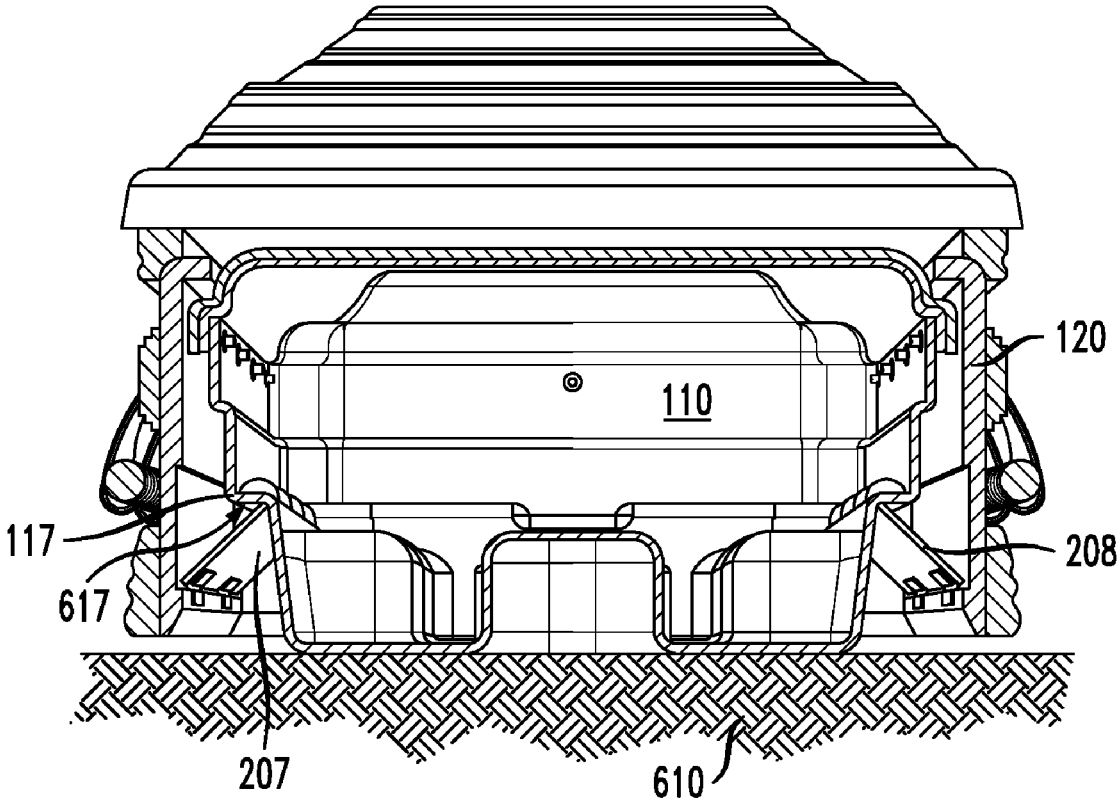
FIG. 6C illustrates the casket assembly with the casket lifted to engage the first and second support leaves in the coffin-support position and against an underside of the ledge.

Referring now to FIGS. 6A-6C, illustrated are sectional views of the casket assembly 100 of FIG. 1 along plane 6-6 of FIG. 1 under different conditions. FIG. 6A illustrates the casket assembly 100 with the coffin 110 and casket 120 resting on a surface 610 with the first and second support leaves 207, 208 in the stowed position. FIG. 6B illustrates the casket assembly 100 with the coffin 110 and casket 120 resting on the surface 610 with the first and second support leaves 207, 208 rotated to the coffin-support position. FIG. 6C illustrates the casket assembly 100 with the casket 120 lifted to engage the first and second support leaves 207, 208 in the coffin-support position and against an underside 617 of the ledge 117. One who is of skill in the art will recognize that the full length support leaves significantly stabilize the coffin 110 with respect to the casket 120 in this configuration.

Refer now back to FIGS. 1 and 6A. When the viewing has finished, the head lid 126 may be closed after the lining materials are folded into the coffin 110. The casket assembly may then be transported to another part of the funeral home where the casket 120 may be temporarily removed to facilitate installation and fastening of the coffin head lid 112 to the coffin base 111 with a plurality of fasteners 114. The casket 120 may then be replaced over the coffin 110 and the support leaves 207, 208 repositioned to the coffin support position. The casket assembly 100 may then be transported to the grave site and placed on a coffin lowering device (not shown). After the mourners have left the graveside, the support leaves 207, 208 are moved to the stowed position and the coffin 110 may be lowered into the grave with the conventional coffin lowering device. The casket 120 may be retained at ground level with simple boards placed under the end panels 123, 124 across the top of the grave. The casket 120 may then be returned to the mortuary supplies for re-use.

Those skilled in the art to which the invention relates will appreciate that other and further additions, deletions, substitutions and modifications may be made to the described embodiments without departing from the scope of the invention.

What is claimed is:

1. A casket assembly, comprising:

an inner coffin including a base having a first side and a first ledge projecting outwardly from said first side;

an outer decorative casket having a first panel, said outer decorative casket removably receiving said inner coffin therein to conceal said coffin base;

a first support leaf having first and second edges; said first support leaf hingedly coupled along said first edge to said first panel, said first support leaf rotating around said first edge between a stowed position and a coffin-support position wherein said second edge is proximate an underside of said first ledge; and a first operating handle coupled to said first support leaf and positively locking said first support leaf in said stowed position or said coffin-support position.

2. The casket assembly as recited in claim 1 further comprising an operating handle bracket coupled to said first panel, and wherein a rod coupled to said first operating handle passes through a first curvilinear aperture in said operating handle bracket.

3. The casket assembly as recited in claim 2 wherein said rod further comprises a collar proximate said first operating handle and said curvilinear aperture has first and second ends wherein said first end comprises a stowed position aperture and said second end comprises a coffin-support position aperture, said collar configured to cooperate with said stowed position aperture or said coffin-support position aperture to lock said first support leaf in either said stowed position or said coffin-support position, respectively.

4. The casket assembly as recited in claim 3 further comprising a first compression spring positioned around at least a portion of said rod and configured to retain said first collar in said stowed position aperture or said coffin-support position aperture.

5. The casket assembly as recited in claim 4 further comprising first and second rod support brackets coupled to said first leaf wherein said first and second rod support brackets have first and second rod apertures therethrough, respectively, and wherein said rod passes through said first and second rod apertures, said first compression spring positioned between said first and second rod support brackets.

6. The casket assembly as recited in claim 5 further comprising a spring stop pin wherein said spring stop pin passes transversely through said rod and captures said first compression spring between said spring stop pin and said first rod support bracket.

7. The casket assembly as recited in claim 6 further comprising a rod stop pin wherein said rod stop pin passes transversely through an end of said rod and prevents said rod from being withdrawn from said first and second rod apertures.

8. A method of manufacturing a casket assembly, comprising:

providing an inner coffin including a base having a first side and a first ledge projecting outwardly from said first side;

providing an outer decorative casket having a first panel, said outer decorative casket removably receiving said inner coffin therein to conceal said coffin base;

hingedly coupling a first support leaf along a first edge of said first support leaf to said first panel, said first support leaf having a second edge parallel said first edge;

configuring said first support leaf to rotate around said first edge between a stowed position and a coffin-support position wherein said second edge is proximate an underside of said first ledge;

coupling a first operating handle to said first support leaf; and configuring said first operating handle to lock said first support leaf in said stowed position or said coffin-support position.

9. The method as recited in claim 8 further comprising:

coupling an operating handle bracket to said first panel; and coupling a rod to said first operating handle wherein said rod passes through a curvilinear aperture in said operating handle bracket.

10. The method as recited in claim 9 further comprising:

forming a collar on said rod proximate said first operating handle, wherein said curvilinear aperture has first and second ends wherein said first end comprises a stowed position aperture and said second end comprises a coffin-support position aperture, said collar configured to cooperate with said stowed position aperture or said coffin-support position aperture to lock said first support leaf in either said stowed position or said coffin-support position, respectively.

11. The method as recited in claim 10 further comprising positioning a first compression spring around at least a portion of said rod and configuring said first compression spring to retain said collar in said stowed position aperture or said coffin-support position aperture.

12. The method as recited in claim 11 further comprising: coupling first and second rod support brackets to said first leaf wherein said first and second rod support brackets have first and second rod apertures therethrough, respectively, and wherein said rod passes through said first and second rod apertures, said first compression spring positioned between said first and second rod support brackets.

13. The method as recited in claim 12 further comprising passing a spring stop pin transversely through said rod and capturing said first compression spring between said spring stop pin and said first rod support bracket.

14. The method as recited in claim 13 further comprising passing a rod stop pin transversely through an end of said rod and preventing said rod from being withdrawn from said first and second rod apertures.

15. A method of using a casket assembly, comprising:

providing an inner coffin including a base having a first side and a first ledge projecting outwardly from said first side;

providing an outer decorative casket having a first panel, said outer decorative casket removably receiving said inner coffin therein to conceal said coffin base;

hingedly coupling a first support leaf along a first edge of said first support leaf to said first panel, said first support leaf having a second edge parallel said first edge;

rotating said first support leaf around said first edge between a stowed position and a coffin-support position wherein said second edge is proximate an underside of said first ledge;

coupling a first operating handle to said first support leaf; and locking said first operating handle and said first support leaf in said stowed position or said coffin-support position.

16. The method as recited in claim 15 further comprising:

coupling an operating handle bracket to said first panel; and passing a rod coupled to said first operating handle through a curvilinear aperture in said operating handle bracket.

17. The method as recited in claim 16 further comprising:

forming a collar on said rod proximate said first operating handle, wherein said curvilinear aperture has first and second ends wherein said first end comprises a stowed position aperture and said second end comprises a coffin-support position aperture, said collar configured to cooperate with said stowed position aperture or said coffin-support position aperture; and locking said first support leaf in either said stowed position or said coffin-support position, respectively.

18. The method as recited in claim 17 further comprising positioning a first compression spring around at least a portion of said rod and configuring said first compression spring to assist in locking said collar in said stowed position aperture or said coffin-support position aperture.

19. The method as recited in claim 18 further comprising: coupling first and second rod support brackets to said first leaf wherein said first and second rod support brackets have first and second rod apertures therethrough, respectively, and wherein said rod passes through said first and second rod apertures, said first compression spring positioned between said first and second rod support brackets.

20. The method as recited in claim 19 further comprising:

passing a spring stop pin transversely through said rod and capturing said first compression spring between said spring stop pin and said first rod support bracket; and passing a rod stop pin transversely through an end of said rod and preventing said rod from being withdrawn from said first and second rod apertures.

* * * * *